US005157226A

United States Patent [19]

Takahashi

[11] Patent Number: 5,157,226

[45] Date of Patent: Oct. 20, 1992

[54] DEVELOPING APPARATUS PRODUCING TONER POWDER CLOUD FOR DEVELOPING IMAGES

[75] Inventor: Shinkichi Takahashi, Yokohama, Japan

[73] Assignee: Canon Kabushiki Kaisha, Tokyo, Japan

[21] Appl. No.: 598,155

[22] Filed: Oct. 16, 1990

[30] Foreign Application Priority Data

Oct. 17, 1989 [JP] Japan ..... 1-269457
Oct. 17, 1989 [JP] Japan ..... 1-269458

[51] Int. Cl.[5] ..... G03G 15/06

[52] U.S. Cl. ..... 118/651; 118/654; 355/247; 355/261

[58] Field of Search ..... 355/247, 248, 249, 261, 355/259, 265; 118/654, 651, 661

[56] References Cited

U.S. PATENT DOCUMENTS 4,387,664 4/1983 Hosono et al. ..... 118/658
4,422,749 12/1983 Hoshino et al. ..... 118/651 X
4,450,220 5/1984 Haneda et al. ..... 355/249 X
4,831,408 5/1989 Yoshikawa et al. ..... 346/157
4,876,574 10/1989 Tajima et al. ..... 355/261 X
4,887,102 12/1989 Yoshikawa et al. ..... 346/157
4,930,438 6/1990 Demizu et al. ..... 118/651
4,949,125 8/1990 Yamamoto et al. ..... 355/261 X
4,962,723 10/1990 Hotomi ..... 355/247 X

FOREIGN PATENT DOCUMENTS 3228094 2/1983 Fed. Rep. of Germany ..... 355/247
57-179865 11/1982 Japan .
61-189565 8/1986 Japan .

*Primary Examiner*—A. T. Grimley
*Assistant Examiner*—Robert Beatty
*Attorney, Agent, or Firm*—Fitzpatrick, Cella, Harper & Scinto

[57] ABSTRACT

A developing apparatus or a color image forming apparatus using the developing apparatus, includes a developer carrying member for carrying electrically charged developer, an electrode plate of elastic material having a side contacted to the developer on the developer carrying member, a vibratory voltage source for forming a vibratory electric field between the developer carrying member and the elastic electrode plate. The vibratory electric field is effective to pop and scatter the developer on the developer carrying member from the neighborhood of the electrode plate into the developing zone, to develop the latent image on the image bearing member.

38 Claims, 6 Drawing Sheets

DEVELOPING APPARATUS PRODUCING TONER POWDER CLOUD FOR DEVELOPING IMAGES

FIELD OF THE INVENTION AND RELATED ART

The present invention relates to a developing apparatus for developing a latent image using a powder cloud of dry developer and an image forming apparatus using the function of such a developing apparatus.

In some developing apparatus using a one component developer not containing carrier particles which are contained in a two component developer, the developer particles in the form of a powder cloud are formed and supplied to an image bearing member.

Japanese Patent Application Publication No. 54384/1983, Japanese Laid-Open Patent Application No. 179865/1982, Japanese Laid-Open Patent Application No. 189565/1986 or the like disclose a powder cloud type developing apparatus wherein the developer carrying member is faced to the image bearing member. An electrically charged developer carried on the developer carrying member is released from the developer carrying member by an electrode supplied with a vibrating voltage to form the powder cloud of the developer in the space between the image bearing member and the developer carrying member. The developer is deposited to the image bearing member in the developing zone in accordance with the latent image pattern.

In these systems, however, the powder cloud is formed to occupy a large space with the result of a slow developing speed, and therefore, a low developing efficiency. In addition, atomization is insufficient, and therefore, the sharpness of the image is not enough. In addition, since the powder cloud is large, the powder can contaminate the inside of the image forming apparatus.

U.S. Pat. Nos. 4,831,408 and 4,887,102 disclose an image forming apparatus wherein a second developed image is formed by supplying a second developer to the surface already having the first developed image. In these systems, the powder cloud type developing apparatus is not used. Since a vibrating electric field is formed between the image bearing member and the developer carrying member of the second developing apparatus, great care should be paid so as to not to disturb the first developed image and so as not to contaminate the second developing apparatus with the developer of the first developed image.

SUMMARY OF THE INVENTION

It is a principal object of the present invention to provide a developing apparatus wherein the developer carried on the developer carrying member is formed into a uniform powder cloud with sufficient density, and wherein the latent image is developed on the developer carrying member with the powder cloud.

It is another object of the present invention to provide a developing apparatus wherein the powder cloud is efficiently formed to develop a latent image.

It is a further object of the present invention to provide a developing apparatus wherein the powder cloud is formed in the developing zone, and wherein sharp images can be produced at high speed and at high efficiency.

It is a yet further object of the present invention to provide a developing apparatus wherein the powder cloud is formed in the limited developing zone to perform the developing action, by which the scattering of the developer is minimized, and therefore, the contamination of the inside of the apparatus is minimized.

It is a yet further object of the present invention to provide an image forming apparatus, wherein a second developer is supplied by a powder cloud type developing apparatus to an image bearing member surface carrying a first developed image without disturbance of the first developed image and without contamination of the second developing apparatus with the first developer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
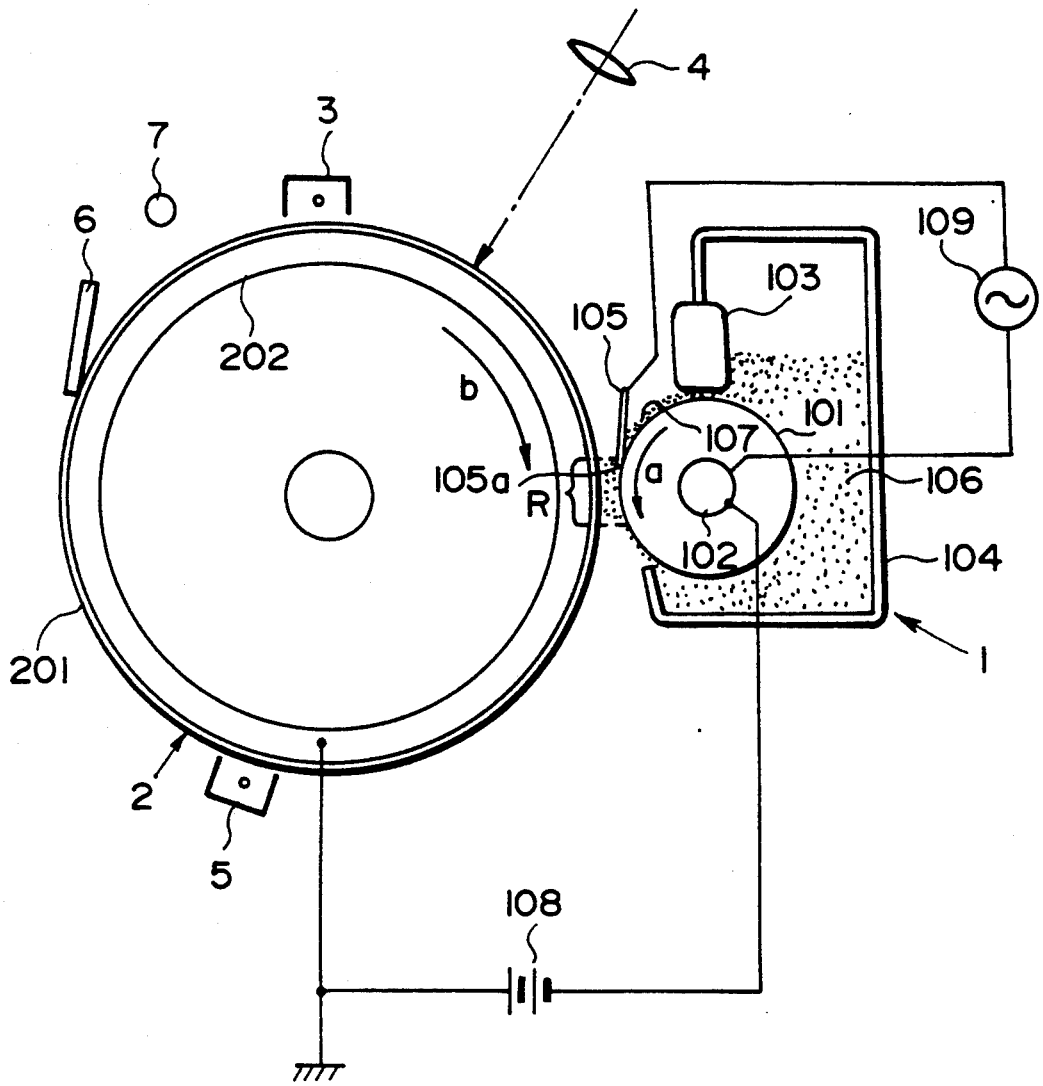
FIG. 1 is a sectional view of an image forming apparatus according to an embodiment of the present invention.

Referring to FIG. 1, there is shown an image forming apparatus using a developing apparatus according to an embodiment of the present invention. In this embodiment, the image bearing member 2 is in the form of a drum and is supported for rotation in the direction indicated by an arrow b. The image bearing member 2 has an electrophotographic photosensitive member 201 on a cylindrical conductive base 202.

The image bearing member 2 is first charged to a predetermined polarity by a charger 3, and is exposed to light corresponding to the information to be recorded through a lens 4, the light being image light corresponding to an original image or a light beam modulated in accordance with the signal to be recorded, by which an electrostatic latent image is formed. The latent image is developed in the developing zone R by a developing apparatus 1 which will be described hereinafter.

The toner image produced by the development is transferred by a transfer charger 5 onto a transfer material such as sheet of paper or the like. Then, the transferred image is fixed on the transfer material by an image fixing device. On the other hand, the toner remaining on the surface of the image bearing member after the image transfer is removed by a cleaning blade 6. The electric charge remaining on the image bearing member 2 is removed by the uniform light application by a lamp 7.

The developing apparatus 1 has a developer container 104 containing a non-magnetic one component developer (toner) 106. The developer container 104 is provided with a front opening, in which a cylindrical developer carrying member 101 is supported by a shaft 102. It is rotatable in a direction indicated by an arrow a. At the top end of the front opening of the developer container 104, a developer regulating member 103 is disposed to form a thin layer of the developer on the developer carrying member 101. Downstream thereof with respect to the rotational direction of the developer carrying member 101, a thin electrode plate 105 is disposed in the manner that a side surface thereof is in contact with the toner layer.

The developer carrying member 101 is usually in the form of a metal roller made of aluminum or stainless steel or a plastic resin roller having a low resistance by containing carbon or the like, which is roughened on its surface by sandblasting treatment or the like so as to have a ten point average roughness (JIS) of 0.1—several microns Rz.

The regulating member 103 may be in the form of an elastic blade made of metal or rubber. It is press-contacted to the developer carrying member 101 to permit formation or a thin .layer of the developer on the developer carrying member. In addition, it is effective to triboelectrically charge the developer to a polarity for developing the latent image by the friction between the developer and the regulating member 103 and between the developer and the developer carrying member 101. The regulating member 103 may be in the form of a regulating roller instead of the blade. When a one component magnetic developer is used, a regulating system in place of the regulating member 103 is constituted by a magnet stationarily disposed in the developer carrying member and a blade made of magnetic material disposed close to the developer carrying member at a position across the developer carrying member from the magnetic pole of the magnet. Then, a thin layer of the magnetic developer electrically charged is formed on the developer carrying member by the function of the magnetic field between the magnet and the magnetic blade, the function of the friction force among the magnetic blade, the developer and the developer carrying member and the function of the triboelectric charge. The blade in this case may be as disclosed in U.S. Pat. No. 4,387,664.

Figure 2:
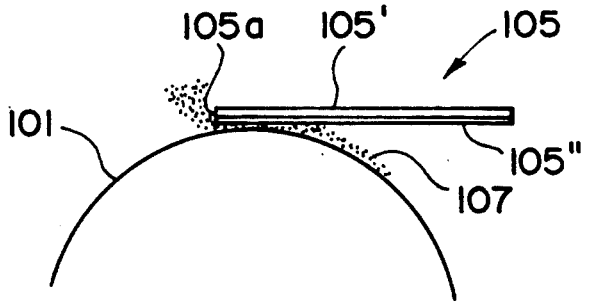
FIG. 2 is a sectional view of a part of a developing apparatus according to an embodiment of the present invention, wherein an electrode plate is illustrated.

The electrode 105 is preferably in the form of an elastic electrode plate made of thin metal plate of aluminum, stainless steel or phosphor bronze or made of thin metal plate 105' (FIG. 2) having a thin insulating material (resin material or alumite or the like) coating 105'' at least at a developer layer side, the coating being effective to control the triboelectric charge of the developer or to prevent electric leakage between the developer carrying member and the electrode 105. The electrode 105 is resiliently urged toward the surface of the developer carrying member 101 with the thin layer of the toner therebetween. The distance between the electrode 105 and the developer carrying member 101 is smaller than a distance between the electrode 105 and the developer carrying member 2.

The relatively free end 105*a* of the electrode 105 is disposed in the developing zone R at a position adjacent to an upstream end with respect to a movement direction of the developer carrying member 101. The developing zone R is defined between the image bearing member 2 and the developer carrying member 101 disposed faced to the image bearing member. In the developing zone R, a minimum clearance is formed between the image bearing member 2 and the developer carrying member 101, and in the zone R, the toner is supplied to the image bearing member 2. The free end 105*a* of the electrode 105 is preferably disposed in the range between an upstream end of the developing zone R and a position away therefrom toward downstream by a distance corresponding to one third of the width of the developing zone R with respect to the movement direction of the periphery of the developer carrying member.

More particularly, the minimum gap t1 (FIG. 3) between the electrode plate 105 and the developer carrying member 101 corresponds to 2–3 developer particles (toner particles) having an average particle size. When the average particle size of the used developer is ten and several microns, the gap is approximately 40 microns or less. In order to form such a small gap, it is preferably that the elastic electrode plate 105 is lightly contacted to the developer carrying member 101 by the elastic force thereof when there is no developer. The contact pressure is preferably such that the electrode plate 105 hardly blocks the developer thin layer 107 formed by the regulating member 103. Alternatively, thin sheets made of insulating synthetic resin are sandwiched between the electrode 105 and the developer carrying member 101 at longitudinally opposite ends of the developer carrying member 101 as spacers to maintain non-contact between the electrode 105 and the developer carrying member 101 when there is no developer on the developer carrying member 101.

The minimum clearance between the developer carrying member 101 and the image bearing member 2 in the developing zone R is 50–500 microns, preferably 100–300 microns, approximately 200 microns for example. When a vibrating electric field is not formed between the electrode 105 and the developer carrying member 101, the developer layer formed on the developer carrying member is out of contact to the developer carrying member 2. A DC voltage source 108 functions to apply a developing bias voltage between the developer carrying member 101 and the image bearing member 2. Between the developer carrying member 101 and the electrode 105, a vibrating voltage is applied by a voltage source 109 to form a vibratory electric field to form a powder cloud of the developer.

Upon development of the latent image, a DC developing bias voltage VD is applied to the carrying member 101, and to the electrode 105, a vibratory voltage containing the component of the voltage VD is applied. The vibratory voltage is a voltage in which a maximum voltage and a minimum voltage repeat alternately as in a sine wave AC voltage wherein a positive voltage and negative voltage appear alternately and repeatedly. The waveform is in the form of sine wave, rectangular wave or triangular wave.

Thus, in the developing zone R a DC developing electrode field is formed between the image bearing member 2 and the developer carrying member 101. The DC developing electric field is such that the DC bias voltage applied to the developer carrying member 101 moves and deposits the developer onto the image bearing member 2 to the image area of the latent image (area to receive the developer to be visualized), and that the bias voltage moves and deposits the developer onto the developer carrying member 101 in the background area of the latent image (the area not to receive the developer).

Between the electrode plate 105 and the developer carrying member 101, a vibratory electric field having alternately changing direction is formed by the vibratory voltage applied to the electrode 105.

Figure 3:
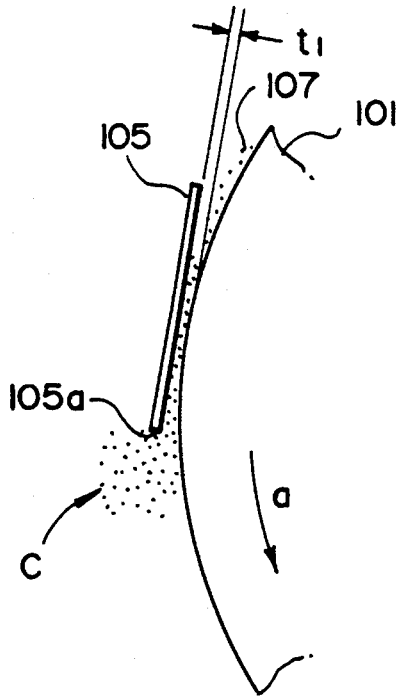
FIG. 3 is a sectional view illustrating a powder cloud.
Figure 4:
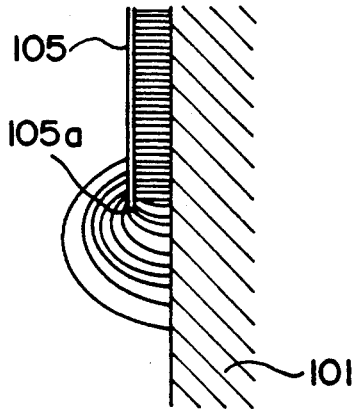
FIG. 4 is a sectional view illustrating electric field produced adjacent to an edge of the electrode plate.

The developer 107 in the form of a thin layer carried on the developer carrying member 101 is brought under the electrode plate 105. When the developer reaches the free end 105*a* of the electrode plate 105, the developer particles are popped by the strong vibrating electric field between the end of the electrode plate 105 and the developer carrying member 101 to form the powder cloud C extending from the free end of the electrode plate 105, as shown in FIG. 3 into the developing zone R. More particularly, the strong vibrating electric field formed adjacent the end 105*a* strongly vibrates the developer particles to pop the developer particles away from the confinement of the electric field. FIG. 4 shows the electric lines of force of the vibratory electric field between the developer carrying member 101 and the electrode plate 105.

As described, the thin developer layer 107 on the developer carrying member 101 is influenced by the strong vibrating electric field by the electrode plate 105, almost all of the developer particles on the developer carrying member constitute the powder cloud in the narrow developing zone, by which the uniform and high density powder cloud is formed in the developing zone R.

The electrode plate 105 may be disposed such that the portion including the free end 105*a* is contacted to the developer carrying member 101 when there is no developer on the developer carrying member 101, or it may be disposed such that the end 105*a* is slightly away from the developer carrying member 101 when there is no developer on the developer carrying member 101. The region in which the electrode plate 105 and the developer carrying member 101 are contacted when there is no developer in the developer carrying member 101 is called "nip". In the latter case, when the developer is passing through the nip to the end 105*a*, the developer is reciprocated in the free space between the developer carrying member 101 and the electrode plate 105 by the vibrating electric field. This functions as a preparation for the powder cloud formation. In the former and latter cases, the developer strongly vibrates in the free space between the developer carrying member 101 and the electrode 105 when the developer approaches the nip. Such strong reciprocating motion, the developer abuts the developer carrying member 101 and the electrode 105, by which the triboelectric charge of the developer is increased and stabilized.

As described in the foregoing, the end 105*a* of the electrode plate 105 is disposed adjacent one end of the developing zone R, and therefore, the vibrating voltage applied to the electrode plate 105 is substantially non-contributable to the development, or the contribution, if any, is quite smaller than the contribution of the voltage source 108 to the development. Therefore, the developing bias voltage source 108 may be set substantially only from the standpoint of the developing action, and therefore, it can be set for the optimum level for the development In order to further reduce the influence, to the developing zone R, of the vibratory voltage applied to the electrode 105, a shielding electrode (not shown) may be provided between the electrode plate 105 and the image bearing member 2.

The developer in the form of the powder cloud formed in the developing zone R, are moved by a combined electric field provided by the potential of the latent image of the image bearing member 2 and the potential of the developer carrying member 101 by the developing bias voltage source 108 to the image area of the latent image pattern of the image bearing member 2 The developer not consumed by the development is deposited and collected to the developer carrying member 101 by the electrostatic attraction force or the like.

Figure 5:
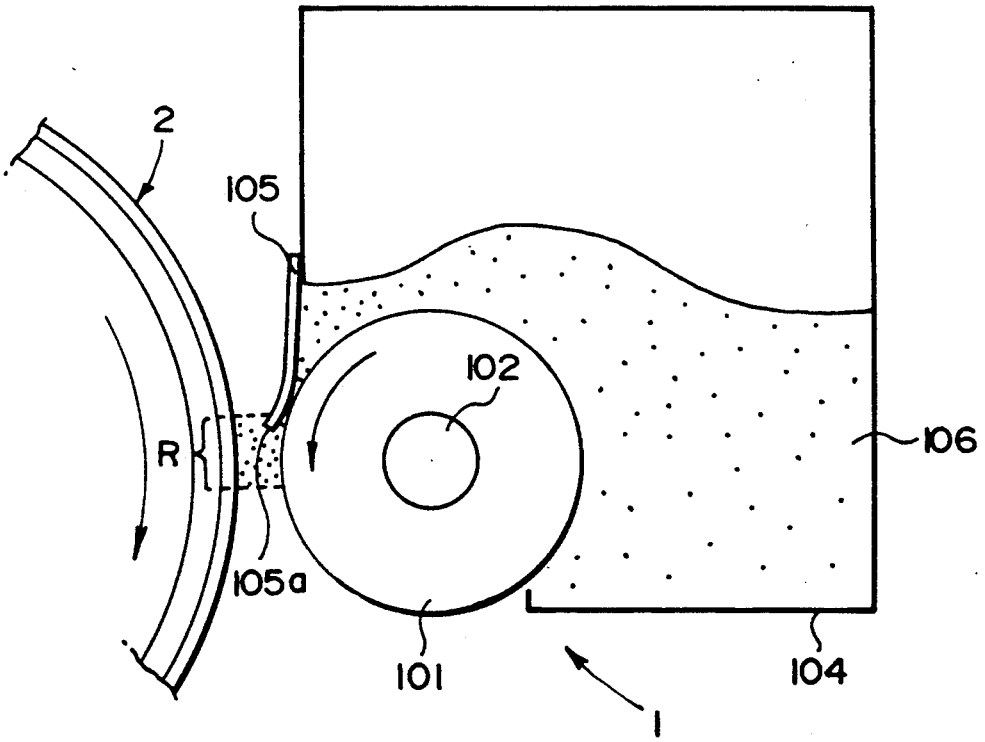
FIG. 5 is a sectional view of a developing apparatus according to another embodiment of the present invention.

FIG. 5 shows another embodiment of the present invention. This embodiment is different from the embodiment of FIG. 1 in that the electrode plate 105 also functions as the developer regulating member 103. The portions not shown in FIG. 5 are the same as in the first embodiment. In the present embodiment, the electrode plate 105 functions to regulate the amount of developer carried to the developing zone R, and also to produce the powder cloud of the developer triboelectrically charged from the end 105*a*, so that the same advantageous effects as in the first embodiment can be accomplished.

Figure 6:
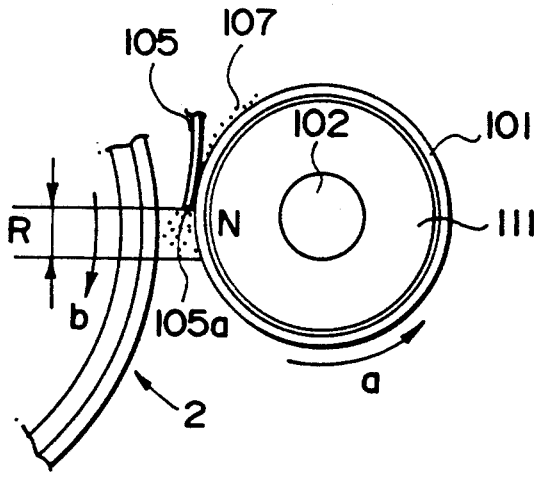
FIG. 6 is a sectional view of a developing apparatus according to a further embodiment of the present invention.

FIG. 6 shows a further embodiment, wherein a one component magnetic developer is used, and wherein a magnet 111 is disposed stationarily in the developer carrying member 101. The magnetic pole (N pole, for example) is disposed corresponding to the developing zone R faced to the latent image bearing member 2.

In this embodiment, similarly to the foregoing embodiments, the powder cloud of the developer is produced in the developing zone. The powder cloud developer is influenced by the electric field of the latent image on the image bearing member, by the electric field by the DC developing bias, and by the magnetic field provided by the magnet 111, so that the developer is deposited on the latent image on the image bearing member to be developed. The magnetic field formed by the magnetic pole in the developing zone R is effective to prevent deposition of the developer to the non-image portion, that is, production of foggy background.

Figure 7:
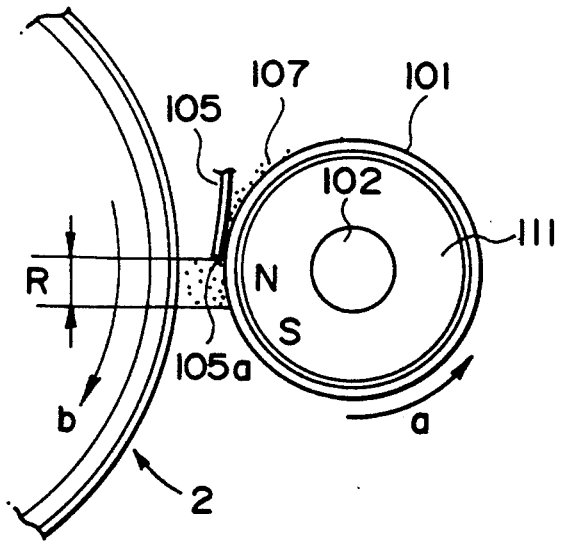
FIG. 7 is a sectional view of a developing apparatus according to a further embodiment of the present invention.

FIG. 7 shows a modified embodiment, that is, modification of FIG. 6 embodiment. In the present embodiment, in addition to the N-magnetic pole for development, an S pole is disposed downstream of the developing zone R with respect to the rotational direction of the developer carrying member 101. The S pole functions to collect the magnetic developer in the form of the powder cloud back to the developer carrying member 101 after the developing action. When the magnetic bias by the N pole is not required for the developing action, only the S pole for the correction of the developer is used without use of the N pole.

Example of the image forming apparatus according to the present invention will be described in more detail.

EXAMPLE 1

In the structure of FIG. 1, the developer carrying member 101 is in the form of a stainless steel roll having a diameter of 20 mm, and the surface thereof was sandblasted so that it had the surface roughness of 1–2 microns (Rz) in ten point average roughness (JIS). The regulating member 103 was made of phosphor bronze plate of 0.2 mm thickness. It was contacted to the surface of the developer carrying member 101 with the line pressure of 100 g/cm.

The developer container 104 contained one component non-magnetic developer made of polyester resin charge control agent, coloring pigment or the like and having a volume average particle size of 12 microns. The developer may contain silica fine particles or the like, as desired. The developer carrying member 101 was rotated at a speed of 100 mm/sec. By doing so, a thin layer 107 of the developer positively charged was formed on the developer carrying member 101, and it had a thickness which is 2–3 times the average particle size of the developer.

The thin elastic plate electrode 105 had approximately 50 microns and was made of aluminum foil. The minimum clearance t1 from the surface of the developer carrying member was 30 microns and was contacted to the developer layer 107. To the electrode plate 105, the vibratory voltage source 109 applied a sine wave AC voltage having the peak-to-peak voltage Vpp of 700 V and having the frequency of 5 KHz was added.

By doing so, the powder cloud of the developer was produced between the elastic electrode 105 and the surface of the developer carrying member 101 and was scattered into the developing zone R, that is, to the front of the free end 105*a*.

In this embodiment, the image bearing member was an organic photoconductor (OPC) as the photosensitive layer 201. The photosensitive drum of 60 mm.dia. was rotated at the speed of 100 mm/sec, and a latent image was formed through an electrophotographic process. The light portion potential of the latent image was −100 V, and the dark portion voltage was −700 V.

To the developer carrying member 101, a DC voltage of −200 V was applied by the voltage source 108.

According to this example, a sharp image was produced without scattering of the developer and without contamination of the image.

EXAMPLE 2

The structure of Example 2 was similar to that of Example 1 with the exception that the elastic electrode plate 105 was supplied with a DC (+50 V) biased AC voltage (vibratory voltage) was applied. It was confirmed that the clear image was produced, similarly to the embodiment 1. Simultaneously, the amount of developer deposited on the elastic electrode plate 105 was significantly reduced.

This is because the electrode is supplied with the vibratory voltage biased with a DC voltage having a polarity, the same as the polarity of the charge of the developer, and therefore, the developer is not easily deposited to the electrode.

EXAMPLE 3

The structure was as shown in FIG. 5. The elastic electrode plate 105 was made of stainless steel thin plate having a thickness of 0.2 mm, and was contacted to the developer carrying member 101 with the pressure of approximately 150 g/cm without the developer. The minimum clearance t1 between the electrode plate 105 and the developer carrying member 101 was 30 microns with the developer layer therebetween. The other structure was as in Example 1. The same clear images were produced as in Example 1.

In the foregoing examples, the regular development is used wherein the high potential portion of the electrostatic latent image (the area not exposed to light, that is, a dark potential VD region) receives the developer, whereas the low potential portion (area exposed to the light, that is, the light potential VL portion) does not receive the developer. The present invention, however, applicable to the case of reverse development wherein the high potential portion does not receive the developer, but the low potential portion receives the developer. Here, "high" and "low" are based on the absolute value of the potential. In the case of the regular development, the developer is charged to the polarity opposite to that of the latent image, whereas in the case of the reverse development, the developer is charged to the same polarity as the polarity of the latent image. In any case, the DC bias voltage level applied to the developer carrying member 101 by the voltage source 108 is between the high potential portion potential VD and the low potential portion potential VL so as to prevent the production of the foggy background, preferably, a level closer to the non-image portion potential (VL in the case of the regular development, and VD in the case of the reverse development) rather than to the image portion potential (VD in the case of the regular development, and VL in the case of reverse development). In any case, the vibratory voltage applied to the electrode plate 105 contains the DC voltage component, it is desirable that the polarity of the DC component is the same as the charge polarity of the developer, since then the amount of the developer deposited on the electrode plate 105 can be reduced.

As for the voltage source 109, it may produce an alternating voltage in the form of a triangular wave, rectangular wave, vibrating wave, a pulse train wave or other deformed wave having a frequency of 1–10 KHz and a peak-to-peak voltage of 100–1000 V. A DC component of 50–300 V, for example, may be added thereto.

Figure 8:
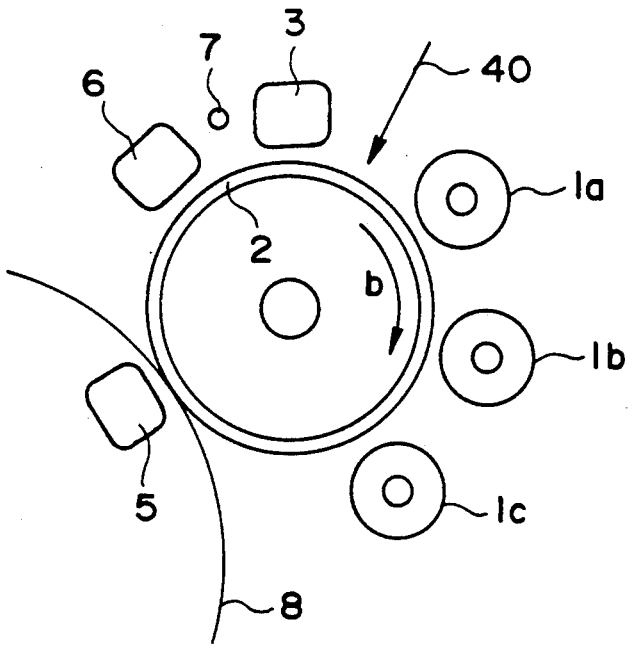
FIG. 8 is a sectional view of an image forming apparatus according to an embodiment of the present invention.

Referring to FIG. 8, another embodiment of the present invention will be described wherein the image forming apparatus is a color image forming apparatus. The image forming apparatus of FIG. 8 is an electrophotographic type comprising an image bearing member 2 in the form of an electrophotographic photosensitive drum, a charger 3, developing devices 1*a*, 1*b* and 1*c*, an image transfer device 5, a cleaning device 6, a discharging lamp 7 and a transfer material 8. Reference numeral 40 designates a light signal to the recorded.

The image bearing member 2 rotates in the direction b, and is first uniformly charged by the charging device 4. Then, it is exposed to the light signal 40 in accordance with the information to be recorded, so that an electrostatic latent image is formed. The latent image is developed by the developing devices 1*a*, 1*b* and 1*c* with A color toner, B color toner and C color toner (one component developers), respectively, in the order named. The visualized image formed with the three color developer is simultaneously transferred onto the transfer material 8 by the transfer device 5. The image is fixed on the transfer material by an image fixing device (not shown). The developer remaining on the image bearing member 2 without being transferred, is removed from the image bearing member 2 by the cleaning device 7, so that the image bearing member 2 is prepared for the next image formation.

Figure 9:
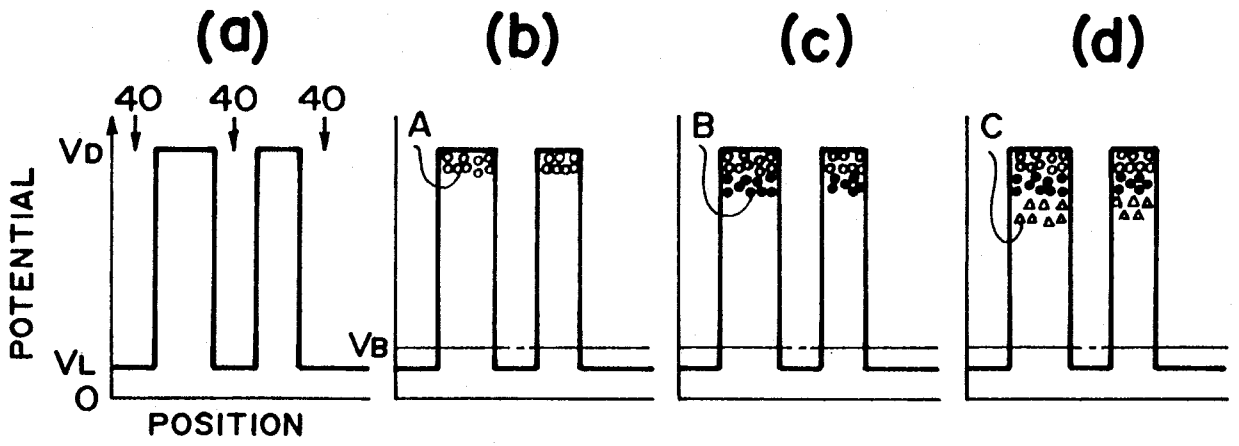
FIGS. 9 and 10 illustrate image formation steps in the image forming apparatus of FIG. 8.
Figure 10:
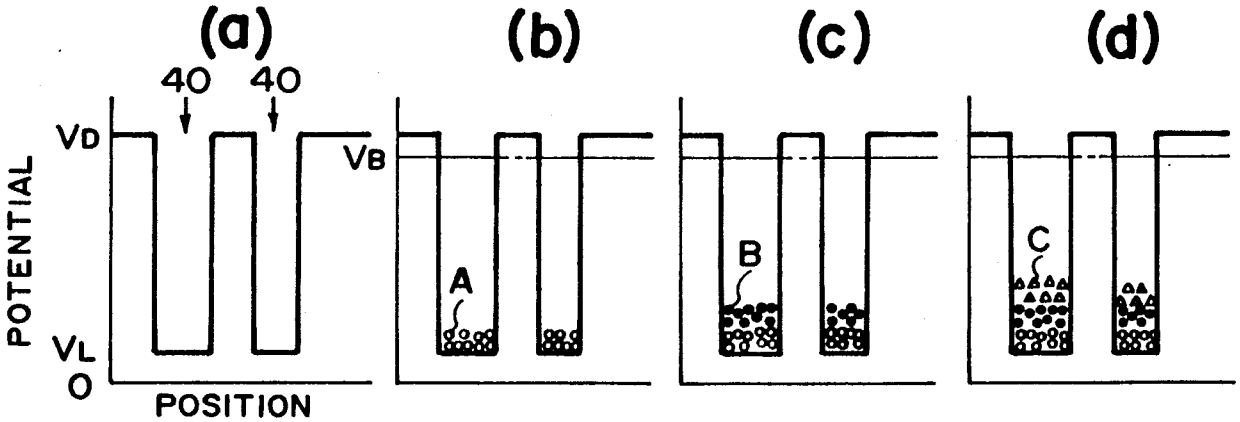

FIGS. 9 and 10 illustrate the image formation steps of the apparatus of FIG. 8, wherein the abscissa represents the position on the image bearing member, and the ordinate represents the surface potential of the image bearing member. FIG. 9 corresponds to an example wherein the developer is deposited on the portion (potential VD) not exposed to the light signal such as the laser beam modulated in accordance with the information to be recorded, the portion having the charge provided by the charger (regular development). FIG. 9 corresponds to an example wherein the developer is deposited to the portion (potential VL) having been exposed to the light image (reverse development).

In FIGS. 9 and 10, (a) corresponds to the state in which the electrostatic latent image has been formed on the image bearing member 2. The portion having received the light signal 40 has a reduced potential (VL). On the other hand, the portion not exposed has the high potential VD.

In each of FIGS. 9 and 10, (b) shows the state in which the latent image is developed with the A color developer by the developing device 1*a*. In the case of the regular development shown in FIG. 9, the developer is charged to the polarity opposite to that of the charge of the image bearing member, and the developing bias voltage VB applied to the developing roller is set in the neighborhood of the level VL, that is, the low potential of the latent image (closer to VD rather than VL), as shown by a chain line, by which the latent image is developed. The developer is deposited on the charge remaining portion VD.

In the case of the reverse development of FIG. 10, the developer is charged to the polarity which is the same as the charge polarity of the image bearing member 2, and the developing bias voltage VB is set to be closer to the level VD, that is, the high potential of the latent image (closer to VL tan VD), as shown by chain line. The developer is deposited on the low potential portion (VL).

In each of FIGS. 9 and 10, (c) and (d) show the state wherein the latent image is developed with the B color and C color developers, wherein the B color developer and the C color developer are overlaid on the A color developer. The colors A, B and C correspond, for example, to cyan, magenta and yellow colors, respectively. In this case, the black color can be provided by combining the A, B and C colors one or two of A, B and C colors are selected, as desired. The developing device of the unnecessary color is disabled by known means such as developing bias VB control, retraction of the developing device from the image bearing member or another known means.

Figure 11:
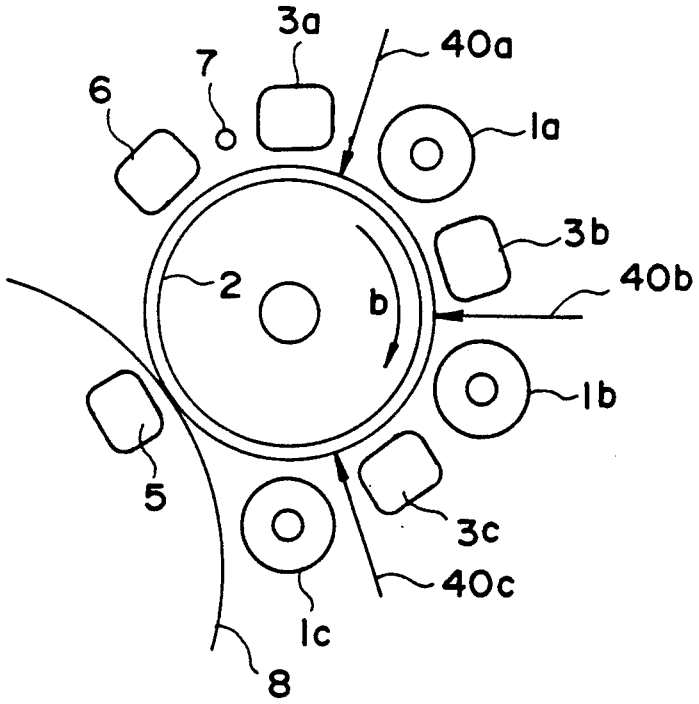
FIG. 11 is a sectional view of an image forming apparatus according to another embodiment of the present invention.
Figure 12:
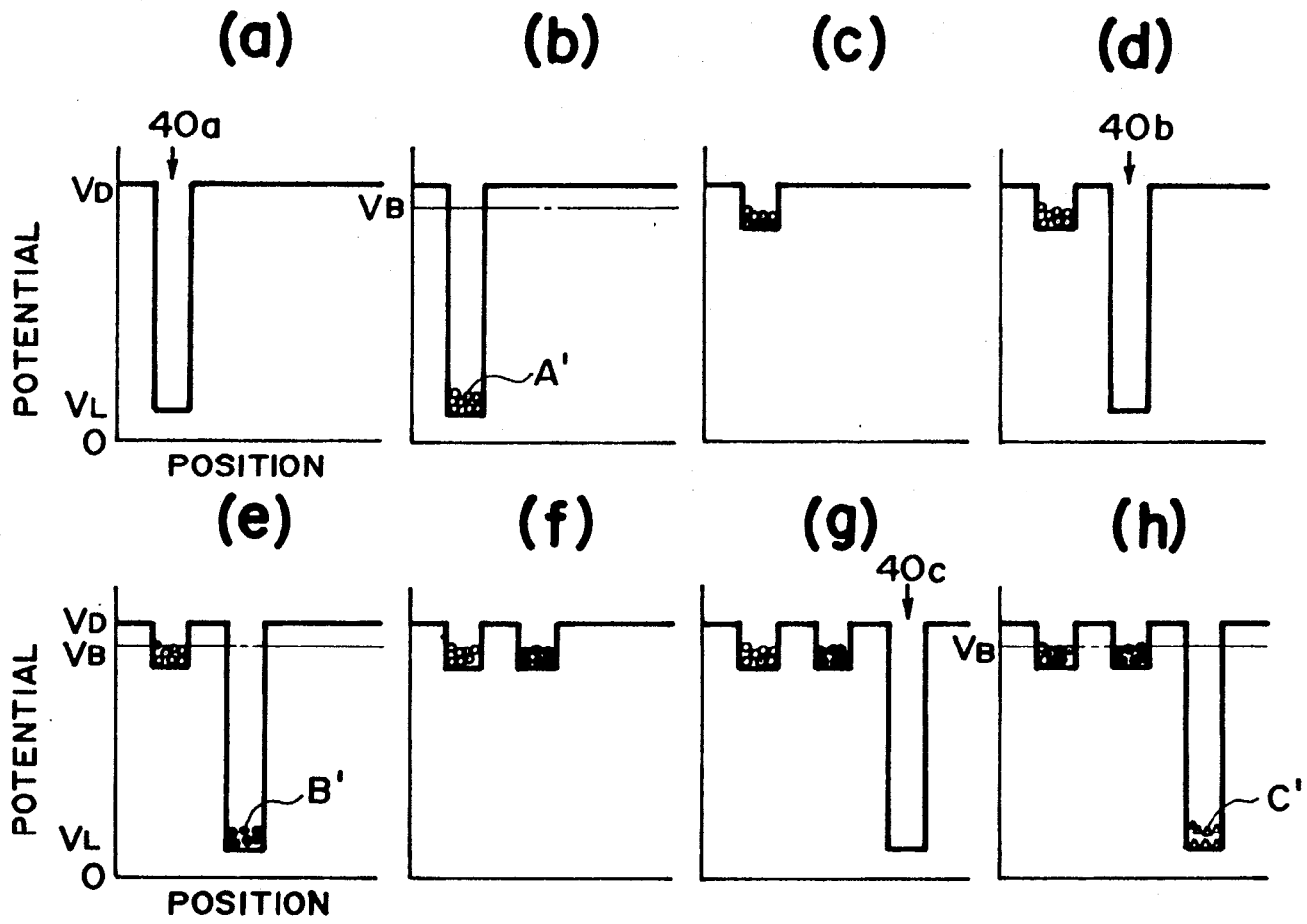
FIG. 12 illustrates the image formation step of the image forming apparatus of FIG. 11.

FIG. 11 shows another embodiment, and FIG. 12 shows the image forming process in this embodiment, wherein the abscissa represents a position on the image bearing member, and the ordinate represents the potential. In FIG. 11 references 4*a*, 4*b* and 4*c* designate chargers, and 40*a*, 40*b* and 40*c* designate light signals such as laser beams modulated respectively in accordance with the information to be recorded for the respective color components. The other fundamental structures are the same as the case of FIG. 8. Similarly to FIG. 8, the image bearing member 2 rotates in the direction indicated by an arrow b, and the surface is uniformly charged by a charger 4*a*. Then, it is exposed to the light signal 40*a* in accordance with the A' color information to be recorded, so that an electrostatic latent image is formed in accordance therewith (FIG. 12(*a*)). The latent image is developed with a one component developer (toner) have the color A' by the developing device 1*a* (FIG. 12(*b*)). Then, by the charger 4*b* the image bearing member is charged again, and the previous latent image is erased, by which the surface potential is substantially made uniform (FIG. 12(*c*)). Thereafter, the light signal 40*b* of color B' is projected onto the image bearing member 2, so that a second latent image is formed (FIG. 12(*d*)). The latent image is developed with the B' color developer by the developing device 1*b* (FIG. 12(*e*)). Similarly, a third latent image is formed (FIG. 12(*g*)) is formed and developed with the C' color developer by the developing device 1*c* (FIG. 12(*h*)) by the charging by the charging device 4*c* (FIG. 12(*f*)) and by the application of the light signal 40*c* for the C' color component. Through the similar steps as in FIG. 8, the image is formed. As shown in the Figures, the charge polarity of the image bearing member by the chargers 4*a*, 4*b* and 4*c* are the same.

In this embodiment, a reverse development is used wherein the toner is deposited on the light potential VL portion. This embodiment, however, is applicable to the regular development wherein the toner is deposited on the dark potential portion VD.

In any case, the B' color developed image and the C' color developed image are formed on the surface of the image bearing member 2 having the A' color developed image, and the A' color image, B' color image and C' color images are simultaneously transferred onto the transfer material 8.

The colors A', B' and C' are red, blue and black, for example, and therefore, three color images can be formed. It is of course possible to form a single or two color image if only one or two developing devices are operated. In this case, the developing device or devices not operates are disabled by not applying the developing bias voltage or by being retracted from the image bearing member, similarly to the foregoing embodiments. Thus, only the light signal corresponding to the developing device to be used is projected on the image bearing member.

The developing bias voltage applied to the developing device 1*a* is the same as the non-image area potential (VD) or nearer to the potential VL than the potential VD to prevent the production of the foggy background. The developing bias voltage applied to the developing device 1*b* is the same as the potential of the toner image of the color A' after the charging by the charger 4*b* (closer to VL than VD) or the potential closer to the potential VL than that potential, by which the deposition of the B' color toner to the non-image area and to the A' color toner image. The developing bias voltage applied to the developing device 1*c* is the same as the potential of the A' and B' color toner image after the charging by the charger 4*c* (closer to VL than VD) or closer to the potential VL than that potential, by which the deposition of the C' color toner onto the non-image area, the A' color toner image and the B' color toner image is prevented.

The developing bias voltage in the foregoing examples, is in the form of a non-vibratory DC bias voltage.

In such an image formation, it is desirable that the toner image formation is performed in the developing step in the manner that the previous toner image is not disturbed, (1) that the development action is such that it does not mechanically damage the previous image, and (2) that the previous image is not disturbed by the electric field in the subsequent developing steps. Otherwise, the toner image is changed from the desired one, and in addition, the toner of the previous color image is mixed in the current developing device, thus mixing different color toners, with the result of deterioration of the developed image. When the above-described developing apparatus is used, such inconveniences are prevented, so that good color images can be formed.

The image forming apparatus will be described more specifically.

EXAMPLE 4

In the structure of FIG. 8, each of the developing devices 1*a*, 1*b* and 1*c* had the structure shown in FIG. 1. The image bearing member 101 had a stainless steel roller having a diameter of 20 mm. The surface thereof was treated with sandblasting so that the surface roughness thereof (ten point average roughness, JIS-B-0610) of 1–2 microns (Rz). The regulating member 103 was made of phosphor bronze plate having a thickness of 0.2 mm. It was contacted to the surface of the image bearing member 101 with a pressure of approximately 100 g/cm. The developer was triboelectrically charged to the negative polarity.

The developer container 104 contained a one component (non-magnetic developer, added by silica particles or the like if desired) made of polyester resin, charge controlling agent, coloring pigment or the like and having a volume average particle size of approximately 12 microns. The developer carrying member 101 was rotated at a speed of 100 m/sec. Then, a thin developer layer (the thickness corresponding to 2–3 developer particles having the average particle size) is formed on the developer carrying member 101.

The electrode plate 105 was made of aluminum foil having a thickness of approximately 50 microns. The minimum clearance t1 between the surface of the image bearing member and the electrode 105 was 30 microns, and the electrode 105 was contacted to the developer layer. A sine wave voltage having a peak-to-peak voltage of 700 V and the frequency of 5 KHz was added thereto by a vibratory voltage source 106.

Then, the powder cloud of the developer was produced between the electrode 105 and the developer carrying member 101, and was dispersed in the developing zone R.

In this example, the image bearing member had the photosensitive drum having a photosensitive layer 201 made of organic photoconductor (OPC) and was rotated at a peripheral speed of 100 mm/sec. Through an electrophotographic process, a latent image shown in FIG. 10 was formed. The light potential VL of the latent image was −100 V, and the dark portion potential of VD was −700 V.

The developing device 1*a* develops the image with a cyan developer; the developing device 1*b* develops the latent image with a magenta developer; and the developing device 1*c* develops the latent image with the yellow developer. Then, a sharp black image was produced. The image was not contaminated, and the developing device is not contaminated by the previous developer or developers.

The developed image by the two developers are not contaminated, without mixture of the developers.

In each of the developing devices 1*a*, 1*b* and 1*c*, the developing bias voltage by the voltage source 108 was −700 V. However, the levels may be slightly changed for the respective developing devices.

EXAMPLE 5

The structure of this example was as shown in FIG. 11, and the developing devices 1*a*, 1*b* and 1*c* had the structure shown in FIG. 1. The electrostatic latent image formed by each of the light signals was developed by the red developer by the developing device 1*a*, with the blue developer by the developing device 1*c* or with the black developer by the developing device 1*c*. Then, three color sharp image was produced. Various conditions of the electrostatic latent image or the like were the same as in Example 4. The developing bias voltage by the voltage source 108, of each of the developing devices 1*a*, 1*b* and 1*c* was −600 V. It is possible tat the levels are slightly changed for the respective developing devices.

In Example 5, the developed image was not contaminated, and the developers are not mixed. In addition, the developed image is not contaminated by the previous developer.

EXAMPLE 6

The structure was as shown in FIG. 11, and the developing devices 1*a*, 1*b* and 1*c* were as shown in FIG. 5. The electrode plate also functioning as the developer layer thickness regulating member 105 was made of a thin stainless steel plate having a thickness of 0.2 mm. It was contacted to the developer carrying member 101 with the pressure of approximately 150 g/cm.

The minimum clearance t1 between the electrode plate 105 and the developer carrying member 101 was 30 microns. The other conditions were the same as in the Example 5. A clear three color image was produced.

The toner image was not produced by the subsequent developing action. The previous toner was not mixed into the developing device.

In the color image forming apparatus, the voltage source 109 may be an alternating voltage source producing a triangular, rectangular, vibrating, pulse train or another deformed wave AC voltage having a peak-to-peak voltage of 100–1000 V and the frequency of 1–10 KHz. The voltage may be biased with a DC voltage (50–300 V, for example) having the polarity which is the same as the charge polarity of the developer.

The first developing device 1*a* for producing the first developed image may be a low type using a magnetic brush rubbing the image bearing member with one component or two component developer, in place of the developing device shown in FIG. 1, or FIGS. 5–7. It may be of the type shown in U.S. Pat. No. 4,395,476 wherein a so-called non-contact developing action is performed while an alternating electric field is formed in the developing zone.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a developer carrying member disposed facing an image bearing member;

an electrode plate having a surface contacted to a layer of a developer carried on said developer carrying member; and a vibratory voltage source for forming a vibratory electric field between said developer carrying member and said electrode plate, wherein the vibratory electric field is effective to produce a powder cloud of the developer adjacent an end of said electrode plate, the powder cloud of the developer being supplied to the image bearing member at a developing zone and wherein the powder cloud is formed from the layer of the developer passing in contact with said electrode plate.

2. An apparatus according to claim 1, further comprising a DC voltage source for applying a DC developing bias voltage to said developer carrying member.

3. An apparatus according to claim 2, wherein said electrode plate is resiliently contacted to said developer carrying member when the developer is not on said developer carrying member.

4. An apparatus according to claim 3, wherein the end of said electrode plate is within the developing zone and is disposed upstream of a position of minimum clearance between the image bearing member and said developer carrying member with respect to a rotational direction of said developer carrying member.

5. An apparatus according to any one of claims 1-4, further comprising a developer layer thickness regulating member, disposed upstream of said electrode plate with respect to a rotational direction of said developer carrying member, for forming a thin layer of the developer on said developer carrying member.

6. An apparatus according to any one of claims 1-4, wherein said electrode plate provides a thin layer of the developer on said developer carrying member.

7. An apparatus according to any one of claims 1-4, wherein a minimum clearance between the image bearing member and said developer carrying member is 50-500 microns.

8. An apparatus according to any one of claims 1-4, wherein the vibratory voltage has a peak-to-peak voltage of 100-1000 V and a frequency of 1-10 KHz.

9. An apparatus according to any one of claims 1-4, wherein id electrode plate comprises an insulative layer at a side contactable to the developer layer.

10. An image forming apparatus comprising:

an image bearing member;

a first developing apparatus for supplying a first developer to said image bearing member to form a first developed image;

a second developing device for supplying a second developer to said image bearing member carrying the first developed image to form a second developed image, said second developing apparatus comprising:

a developer carrying member disposed facing said image bearing member;

an electrode plate having a surface contacted to a layer of the developer carried on said developer carrying member; and a vibratory voltage source for forming a vibratory electric field between said developer carrying member and said electrode plate, wherein the vibratory electric field is effective to produce a powder cloud of the second developer adjacent an end of said electrode plate, the powder cloud of the second developer being supplied to said image bearing member at a developing zone and wherein the powder cloud is formed from the layer of the developer passing in contact with said electrode plate.

11. An apparatus according to claim 10, further comprising transfer means for simultaneously transferring the first developed image and the second developed image onto a transfer material.

12. An apparatus according to claim 11, further comprising a DC voltage source for applying a DC developing bias voltage to said developer carrying member.

13. An apparatus according to claim 12, wherein said electrode plate is resiliently contacted to said developer carrying member when the second developer is not on said developer carrying member.

14. An apparatus according to claim 13, wherein the end of said electrode plate is within the developing zone and is disposed upstream of a position of minimum clearance between the image bearing member and said developer carrying member with respect to a rotational direction of said developer carrying member.

15. An apparatus according to any one of claims 10-14, further comprising a developer layer thickness regulating member, disposed upstream of said electrode plate with respect to a rotational direction of said developer carrying member, for forming a thin layer of the second developer on said developer carrying member.

16. An apparatus according to any one of claims 10-14, where said electrode plate provides a thin layer of the second developer on said developer carrying member.

17. An apparatus according to any one of claims 10-14, wherein a minimum clearance between said image bearing member and said developer carrying member is 50-500 microns.

18. An apparatus according to any one of claims 10-14, wherein the vibratory voltage has peak-to-peak voltage of 100-1000 V and a frequency of 1-10 KHz.

19. An apparatus according to any one of claims 10-14, wherein said electrode plate comprises an insulative layer at a side contactable to the second developer layer.

20. A developing apparatus, comprising:

a rotatable developer carrying member for carrying a one-component developer and disposed facing an image bearing member;

an electrode plate having a surface contacted to a layer of a developer carried on said developer carrying member, said electrode plate being elastically urged for contact to the developer layer; and a vibratory voltage source for forming a vibratory electric field between said developer carrying member and said electrode plate, wherein the vibratory electric field adjacent to an end of said electrode plate is effective to produce a powder cloud of the developer adjacent the end of said electrode plate, the powder cloud of the developer being supplied to the image bearing member at a developing zone and wherein the powder cloud is formed from the developer layer passing in contact with said electrode plate and wherein the end of said electrode plate is within the developing zone and is disposed upstream of a position of minimum clearance between the image bearing member and said developer carrying member with respect to a rotational direction of said developer carrying member.

21. An apparatus according to claim 20, wherein said vibratory voltage source applies to said electrode plate the vibratory voltage which is biased with a DC voltage of a polarity which is the same as a charging polarity of the developer.

22. An apparatus according to claim 21, further comprising a DC voltage source for applying a DC developing bias voltage to said developer carrying member, the DC developing bias voltage having a level between a predetermined high potential and a predetermined low potential of a latent image to be developed.

23. An apparatus according to claim 22, wherein said electrode plate comprises an elastic thin plate and is resiliently contacted to said developer carrying member when the developer is not on said developer carrying member.

24. An apparatus according to claim 23 wherein a minimum clearance between the image bearing member and said developer carrying member is 50–500 microns.

25. An apparatus according to claim 24, wherein the vibratory voltage has a peak-to-peak voltage of 100–1000 V and a frequency of 1–10 KHz.

26. An apparatus according to claim 25, wherein aid electrode plate comprises an insulative layer at a side contactable to the developer layer.

27. An apparatus according to any one of claims 20–26, further comprising a developer layer thickness regulating member, disposed upstream of said electrode plate with respect to a rotational direction of said developer carrying member, for forming a thin layer of the developer on said developer carrying member.

28. An apparatus according to any one of claims 20–26, wherein said electrode plate provides a thin layer of the developer on said developer carrying member.

29. An image forming apparatus, comprising:

a rotatable image bearing member;

a first developing apparatus for supplying a first developer to said image bearing member to form a first developed image;

a second developing device for supplying a second developer to said image bearing member carrying the first developed image to form a second developed image, said second developing apparatus comprising:

a rotatable developer carrying member disposed facing said image bearing member;

an elastic electrode plate resiliently urged to said developer carrying member, said electrode plate having a surface contacted to a layer of the second developer carried on said developer carrying member, wherein an end of said electrode plate is within a developing zone and is disposed upstream of a position of minimum clearance between said image bearing member and said developer carrying member with respect to a rotational direction of said developer carrying member; and a vibratory voltage source for forming a vibratory electric field between said developer carrying member and said electrode plate, wherein the vibratory electric field adjacent to the end of said electrode plate is effective to produce a powder cloud of the second developer adjacent an end of said electrode plate, the powder cloud of the developer being supplied to the image bearing member at a developing zone and wherein the powder cloud is formed from the layer of the developer passing in contact with said electrode plate.

30. An apparatus according to claim 29, further comprising transfer means for simultaneously transferring the first developed image and the second developed image onto a transfer material.

31. An apparatus according to claim 30, wherein said vibratory voltage source applies to said electrode plate the vibratory voltage which is biased with a DC voltage of a polarity which is the same as a charging polarity of the second developer.

32. An apparatus according to claim 31, further comprising a DC voltage source for applying a DC developing bias voltage to said developer carrying member.

33. An apparatus according to claim 32, wherein said electrode plate is resiliently contacted to said developer carrying member when the second developer is not on said developer carrying member.

34. An apparatus according to claim 33, wherein a minimum clearance between said image bearing member and said developer carrying member is 50–500 microns.

35. An apparatus according to claim 34, wherein the vibratory voltage has a peak-to-peak voltage of 100–1000 V and a frequency of 1–10 KHz.

36. An apparatus according to claim 34, wherein said electrode plate comprises an insulative layer at a side contactable to the second developer layer.

37. An apparatus according to any one of claims 29–36, further comprising a developer layer thickness regulating member, disposed upstream of said electrode plate with respect to a rotational direction of said developer carrying member, for forming a thin layer of the second developer on said developer carrying member.

38. An apparatus according to any one of claims 29–36, wherein said electrode plate also functions as a member for providing a thin layer of the second developer on said developer carrying member.

* * * * *

UNITED STATES PATENT AND TRADEMARK OFFICE

CERTIFICATE OF CORRECTION

PATENT NO. : 5,157,226

DATED : October 20, 1992

INVENTOR(S) : Takahashi

It is certified that error appears in the above-identified patent and that said Letters Patent is hereby corrected as shown below:

COLUMN 1

Line 11, "apparatus" should read --apparatuses--.

COLUMN 4

Line 9, "member" should read --member 2--; and
Line 26, "preferably" should read --preferable--.

COLUMN 6

Line 2, "ment" should read --ment.--; and
Line 9, "are" should read --is--.

COLUMN 9

Line 67, "have" should read --having--.

COLUMN 10

Line 33, "not operates" should read --not operating--.

COLUMN 12

Line 6, "three color" should read --a three color--; and
Line 12, "tat" should read --that--.

UNITED STATES PATENT AND TRADEMARK OFFICE

CERTIFICATE OF CORRECTION

PATENT NO. : 5,157,226

DATED : October 20, 1992

INVENTOR(S) : Takahashi

It is certified that error appears in the above-identified patent and that said Letters Patent is hereby corrected as shown below:

COLUMN 13

Line 36, "id" should read --said--.

COLUMN 15

Line 14, "aid" should read --said--.

Signed and Sealed this

Thirtieth Day of November, 1993

*Attest:*

*Attesting Officer*

BRUCE LEHMAN

*Commissioner of Patents and Trademarks*